US007313939B2

(12) United States Patent
Nobata

(10) Patent No.: US 7,313,939 B2
(45) Date of Patent: Jan. 1, 2008

(54) HYDROFORMING MACHINE AND A METHOD OF HYDROFORMING

(75) Inventor: Yasuhiro Nobata, Toyota (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 24 days.

(21) Appl. No.: 11/346,223

(22) Filed: Feb. 3, 2006

(65) Prior Publication Data

US 2006/0185413 A1 Aug. 24, 2006

(51) Int. Cl.
*B21D 9/15* (2006.01)
*B21D 26/02* (2006.01)

(52) U.S. Cl. ..... 72/57; 72/60; 72/350; 29/421.1

(58) Field of Classification Search ..... 72/56, 72/57, 58, 60, 350; 29/421.1
See application file for complete search history.

(56) References Cited

U.S. PATENT DOCUMENTS 3,208,255 A * 9/1965 Burk ..... 72/57
3,596,485 A * 8/1971 Burk ..... 72/57
4,314,468 A * 2/1982 Baril et al. ..... 72/57
4,472,955 A * 9/1984 Nakamura et al. ..... 72/57
6,006,567 A * 12/1999 Brown et al. ..... 72/58
6,708,543 B2 * 3/2004 Yoshioka et al. ..... 72/57

FOREIGN PATENT DOCUMENTS

JP 2003-266132 9/2003

* cited by examiner

*Primary Examiner*—David B Jones
(74) *Attorney, Agent, or Firm*—Finnegan, Henderson, Farabow, Garrett & Dunner, LLP

(57) ABSTRACT

A hydroforming machine characterized by a die 2 having an opening on the upper surface and a fluid tank 2*a* filled with fluid, a holder 3 being able to hold a periphery part between the die 2 and itself, a punch 4 being movable in a direction into or out for the fluid tank 2*a*, and a pressure controller 5 controlling the fluid pressure in the fluid tank 2*a* according to the position of the punch 4.

5 Claims, 8 Drawing Sheets

HYDROFORMING MACHINE AND A METHOD OF HYDROFORMING

FIELD OF THE INVENTION

This invention relates to the technology of a hydroforming machine. More particularly, it is related to the technology of preventing wrinkles in products after molding, by adjusting pressure of a fluid acting on a blank.

BACKGROUND OF THE INVENTION

Description of Prior Art

Increasingly strict environmental regulations against automobile emissions require an increase in the cleaning efficiency of a catalyst by reducing a heat capacity of an exhaust manifold, which is one of the members of the exhaust gas passage of a car. Making the material thinner causes a temperature of the exhaust passage to rise more quickly, and more quickly activate the catalyst.

When molding a blank into a complex form like an exhaust manifold, which is made from a thin metal board (thin board), usually an ironing procedure has been chosen. However in the ironing, a wrinkle is indicative of poor fabrication. Wrinkle occurs, when distortion in the shrinkage direction occurs in the blank molding, and is especially easy to generate when a thin board has low stiffness.

Generally, there are three methods of preventing wrinkle during ironing with a die, (1) to prepare a bead for removing wrinkle in the part of a blank, having a possibility to wrinkle, (2) to prepare a bead on the part of a mold, corresponding to a wrinkle, and (3) to mold a blank by two or more operations for avoiding large distortion in the shrinkage direction on a specific part of the blank. However, method (1) requires preparing a bead on the blank. It does not work when the shape of the product has many limitations. Moreover, method (2) may induce another problem, such as stretching and cracking, for a product, and some forms of products make it difficult to determine the forming conditions which generate neither wrinkle nor stretching and cracking. Furthermore, method (3) tends to create a dent, called a shock line, in the side of the product after molding. Method (3) also requires an increase in the number of processing steps and cost. When molding a complex shape, like an exhaust manifold, it is difficult to prevent a wrinkle by using any of methods (1), (2), or (3).

A hydroforming machine is known which forms a board-like blank using the pressure of liquid as forming equipment suitable for forming thin board in a complicated form while preventing wrinkle. Generally, a conventional hydroforming machine applies pressure on one side of a board shape blank with liquids, such as water and oil, deforms the blank along with the mold etc. of predetermined shape. Furthermore, the hydroforming machine applies pressure on an internal surface of a tubular object, deforms the outer surface of the tubular object along with the mold of predetermined shape.

In FIG. 8, a conventional hydroforming machine 101 comprises a die 102 with an opening only on the upper surface. A fluid tank 102*a* filled up with a liquid is provided, with, a holder 103 which can pinch the periphery part of thin board 111 between die 102 and itself, and a punch 104 which is movable in the direction extracted from the fluid tank 102*a* and inserted into the fluid tank 102*a*. When the fluid tank 102*a* is filled with the liquid, the thin board 111 is pinched between a die 102 and a holder 103, a punch 104, which is installed in a hole 103*a* bored through the holder 103, is moved in the direction of insertion into the liquid tank 102*a*. Consequently, the pressure of liquid fluid in the tank 102*a* increases according to the position of the punch 104 (amount which the punch 104 is inserted into the fluid tank 102). Thin board 111 is deformed along with the shape of a tip part of punch 104.

Generally, the hydroforming machine presses a blank hard against a die with liquid pressure, each part of the blank being pressed hard at a right angle to the surface of the die contacting the blank at almost the same pressure. There is an advantage that it is possible to control the imbalance of a flow of the blank material (small flow at a portion of the blank with the strong restraint by the die, large flow at a portion of blank with the weak restraint). The advantage contributes to the prevention of wrinkle.

A hydroforming machine disclosed in Japanese Laid Open Gazette No. 2003-266132,A, is conventional. In this reference, a hydroforming machine comprises an upper die in which a cavity was formed, and a lower die which can pinch the peripheral part of a board-like blank between the upper die and itself, feeds liquid between a lower die and the blank, and deforms the blank along with the cavity of the upper die.

However, in the case of the above-mentioned hydroforming machine 101, the pressure of a liquid filling the fluid tank 102*a* and the position of punch 104 have a one-to-one correspondence. It is not possible to control the pressure of the fluid independently without changing the position of the punch 104. Therefore, by using hydroforming machine 101, it is difficult to prevent wrinkle at some shape of the formed products from thin board 111. Moreover, in hydroforming machine of the patent reference 1, at the start of processing, the blank is not in contact with cavity surface. For this reason, there is a greater tendency for wrinkle to occur depending on the final shape of the product.

SUMMARY OF THE INVENTION

In consideration of the above-mentioned problem, this invention offers a hydroforming machine which effectively prevents wrinkles on complex products.

Subjects which this invention is going to solve are mentioned above. Means for solving this subject is explained below.

According to one aspect of the invention there is provided a hydroforming machine molding a board shape blank having a lower die having an opening on the upper surface and a fluid tank filled with fluid, an upper die being able to hold a periphery part between the lower die and the upper die, a movable object being movable in a direction into or out for the fluid tank, and a fluid pressure controller controlling the fluid pressure in the fluid tank according to the position of the movable object. In accordance with the invention, it is possible to prevent generating wrinkle effectively when a board-like blank is formed in a complicated shape. The thinner the blank the larger an effect of preventing wrinkle becomes.

According to other aspect of the invention there is provided a hydroforming machine, wherein the fluid pressure controller comprises, a passage connecting the fluid tank and an outside of the lower die, a valve arranged at a halfway of the passage, a fluid pressure detection means which detects pressure of fluid in the fluid tank; and a movable object position detection means which detects a position of the movable object. In accordance with the invention, the pressure of the water, filled in the fluid tank, can be adjusted with simple composition without using actuators, such as hydraulic cylinder, etc. Maintenance becomes easy and the manufacture cost of hydroforming machine can be reduced.

According to another aspect of the invention there is provided the hydroforming machine, wherein the board shape blank has a dent approximately fitting with the tip of the movable object. In accordance with the invention, while the tip part of a movable object contacts blank, it mitigates distortion of the shrinkage direction generated to a contact part. And it suppresses generating of wrinkle more effectively.

According to another aspect of the invention there is provided a method for hydroforming a board shape blank by a hydroforming machine, wherein the hydroforming machine comprises a lower die having an opening on the upper surface and a fluid tank filled with fluid, an upper die being able to hold a periphery part between the lower die and the upper die, and a movable object being movable in a direction into or out for the fluid tank, wherein the board shape blank has a dent approximately fitting with the tip of the movable object. In order to the invention, it prevents generating of wrinkle for board-like blank effectively also in the case of forming complicated shape. Especially, the thinner the blank the lager deterrence effect becomes about generating of wrinkle. Moreover, while the tip part of a movable object contacts the blank, it can mitigate distortion of the shrinkage direction generated to a contact part, and can suppress generating of wrinkle more effectively.

DESCRIPTION OF THE PREFERRED EMBODIMENT

Figure 1:
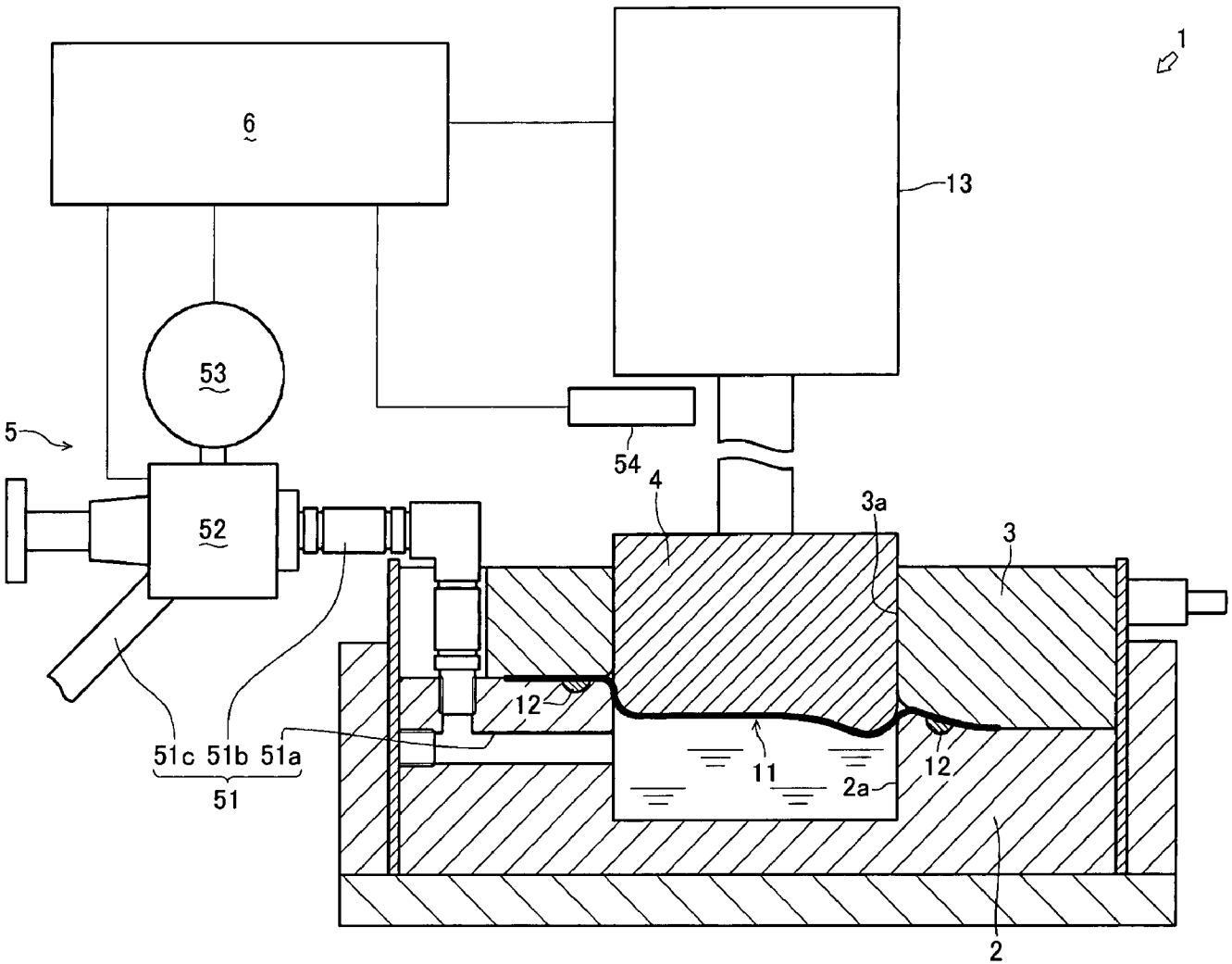
FIG. 1 is a side sectional view showing one form of operation of hydroforming machine concerning this invention.

Below, a hydroforming machine 1 which is an embodiment of the hydroforming machine of this invention is explained using FIG. 1. In addition, a hydroforming machine 1 of this embodiment is equipment for forming thin boards 11 for an exhaust manifold of a car. This invention is widely applicable to thin board formed in a complicated shape. It is not limited to the use of a hydroforming machine 1.

A hydroforming machine 1 comprises a die 2, a holder 3, a punch 4, a pressure controller 5, and a control device 6, etc.

A thin board 11 in this embodiment is preferably a blank of SUS, with a thickness of 0.4 mm. The material for the blank is not limited to SUS. Various metals, such as titanium, copper, and aluminum, can be used. Moreover, the thickness of the blank is not limited. Hydroforming machine 1 of the embodiment has larger effect of the prevention of generating wrinkle as compared with conventional hydroforming machine.

The die 2 is an example of the embodiment of a lower die of hydroforming machine of this invention. On an upper surface of the die 2, a fluid tank 2*a* with an opening at the upper surface is formed, it is filled up with water. In this embodiment, water is used for filling up the fluid tank 2*a*. Furthermore, the liquid of other kinds, like oil, etc., should be useful for filling the fluid tank 2*a*. A slot, which is ring-like shape in top view, is formed on the upper surface around the fluid tank 2*a*. The O ring 12 is fitted in this slot.

A holder 3 is an example of an upper die in a hydroforming machine of this invention. The holder 3 is arranged above the die 2. The holder 3, which actuated by an actuator not illustrated, can move between the position distant from the die 2 and the position in which pinching the periphery part of the thin board 11 with the die 2.

Punch 4 is an example of a hydroforming machine of this invention, the punch 4 being installed with an ability to slide vertically in a through hole 3*a*, the through hole 3*a* formed at the position corresponding to the fluid tank 2*a* of the die 2 on the holder 3. The tip part of the punch 4 is a portion which enters the fluid tank 2*a*. The shape of the tip is equivalent to the shape of the exhaust manifold of a car, and has complex curved surface. The exhaust manifold is a product obtained by forming the thin board 11. The punch 4 moves in the vertical direction to a holder 3 by the hydraulic cylinder 13. In addition, the actuator which moves punch 4 in the vertical direction to a holder 3 may not be limited to hydraulic cylinder 13, also other actuators are sufficient as it.

Pressure controller 5 adjusts the pressure of the liquid with which fluid tank 2*a* was filled up according to the position of punch 4, the amount of insertion into fluid tank 2*a* of punch 4 at the time of forming the thin board 11. The pressure controller 5 of the embodiment possesses a through hole 51, a valve 52, a pressure sensor 53, and position sensor 54, and so on.

Through hole 51 is a passage which opens fluid tank 2*a* and the exterior of die 2 for free passage at the portion of die 2 except the opening of the fluid tank 2*a* formed on the upper surface of die 2. The through hole 51 of this embodiment possesses a communicating passage 51*a*, a piping 51*b*, a piping 51*c*, etc.

The communicating passage 51*a* is a passage drilled in the inside of the die 2, one of the ends is connected with the side surface of the fluid tank 2*a*, and the other end is connected with the external surface of die 2.

The piping 51*b* is connected to one port of the other ends of the communicating passage 51*a*, and the valve 52. The piping 51*c* has one end connected to the port of another side of the valve 52, and the other end opened to outside.

The valve 52 is a valve arranged at the halfway part (in this embodiment, between piping 51*b* and piping 51*c*) of through hole 51.

By closing the valve 52, piping 51*b* and piping 51*c* are intercepted, and piping 51*b* and piping 51*c* are opened for free passage by opening a valve 52.

The pressure sensor 53 is an example of the liquid pressure detection means in the hydroforming machine of this invention.

In this embodiment, the pressure sensor 53 is connected to a valve 52, exactly through the communicating passage 51*a* from fluid tank 2*a*, and the piping 51*b*, and the valve 52, and the pressure of the water, filled in the fluid tank 2*a*, is detected.

The position sensor 54 is an example of the position detection means for the movable object of a hydroforming machine of the invention.

The position sensor 54 detects the position of the punch 4, or amount o£ insertion to the fluid tank 2*a* of punch 4.

Thus, the pressure controller 5 of this embodiment is able to control the pressure of the water filled in the fluid tank 2*a* simply, without using actuators, such as hydraulic cylinder. Thereby maintenance becomes easier and the manufacturing cost becomes smaller.

A control device 6 opens and closes a valve 52 based on the pressure of the water filled in the fluid tank 2*a* detected by the pressure sensor 53, and the position of the punch 4 detected by the position sensor 54.

The controller 6 of the embodiment connected with the hydraulic cylinder 13 of an actuator (not illustrated), controls them according to the program.

A control device 61 provides a storing means to store programs, an expansion means to expand a program, an operation means to perform a predetermined operation according to the program, an input means for inputting the data for performing predetermined operation etc. from the outside, and a display means to display the data inputted by the result of the operation by the operation means, or the input means etc.

In addition, the control device 61 may be, for example, a personal computer, or a workstation.

The method of forming thin board 11 by the hydroforming machine 1 is explained using FIG. 1.

First, the fluid tank 2*a* is filled up with water and the thin board 11 is arranged in the predetermined position of the upper surface of the die 2. In this embodiment, the form of the upper surface of die 2 is not planar; it leans to one side a little. The thin board 11 is also beforehand crooked according to the inclination of the die 2. Moreover, when the tip part of the punch 4 and the portion with which it contacts are flat and smooth in thin board 11; the punch 4 contacts the thin board 11, and the distortion of the shrinkage direction occurs in the contacted part. With some magnitude of distortion, it becomes the cause of generating a wrinkle. Therefore, the portion which contacts with the tip part of punch 4 in the thin board 11, should be made a cavity being roughly the same shape as the tip portion of the punch 4. In addition, the method is not limited to making a cavity roughly the same shape as the tip portion of the punch 4, at the portion which contacts the tip part of the punch 4 in the thin board 11. It is also sufficient to use the usual stamping forming.

Next, the holder 3 is moved from the position distant from die 2 to the position which holds the periphery part of thin board 11 between die 2 and itself. At this time, the holder 3 is pushed against die 2 by predetermined power by the actuator which is not illustrated. Consequently, the periphery part of thin board 11 is restrained with die 2 and a holder 3. Moreover, the O ring 12 arranged at the periphery part of the fluid tank 2*a* is suck on the undersurface of thin board 11. Thereby, the water fluid in the tank 2*a* does not leak from between thin board 11 and die 2

Then, the punch 4 is moved in the direction inserted in the fluid tank 2*a*. When the punch 4 is moved in the insert direction in the fluid tank 2*a*, the tip part of the punch 4 contacts the upper surface of thin board 11. In the thin board 11, the portion which has countered with the fluid tank 2*a* is deformed, and is pushed into the inside of the fluid tank 2*a* along with the shape of the tip part of the punch 4.

When the punch 4 is made to insert in fluid tank 2*a*, the sum of the volume of the space becomes small, the pressure of the water with which fluid tank 2*a* was filled up rises. In here the space is from the fluid tank 2*a* by which the opening on the upper surface of die 2 was blockaded by thin board 11 through the communicating passage 51*a* and piping 51*b*, to the valve 52. Moreover, the control device 6 discharges outside some water fluid in the tank 2*a* by opening the valve 52, the pressure of the water fluid in the tank 2*a* is reduced. In the process which moves the punch 4 in the direction inserted in fluid tank 2*a*, the hydroforming machine 1 is able to control the pressure of water filled in the fluid tank 2*a* can be adjusted according to the position of the punch 4 by opening and closing a valve 52 suitably.

After the punch 4 is inserted in fluid tank 2*a* until it becomes a predetermined position, the valve 52 is opened and the pressure of the water filled in the fluid tank 2*a* is lowered to normal pressure. And the punch 4 is moved in the direction evacuated from fluid tank 2*a*, the holder 3 is moved to the position distant from the die 2. The formed thin board 11, i.e., exhaust manifold, is taken out.

About the modification action of the thin board 11 is explained, in FIG. 3 to the FIG. 7, on the two conditions, the conditions of (A) shown with a thick dashed line in FIG. 2 below, and the conditions of (B) shown as a thick solid line.

Figure 8:
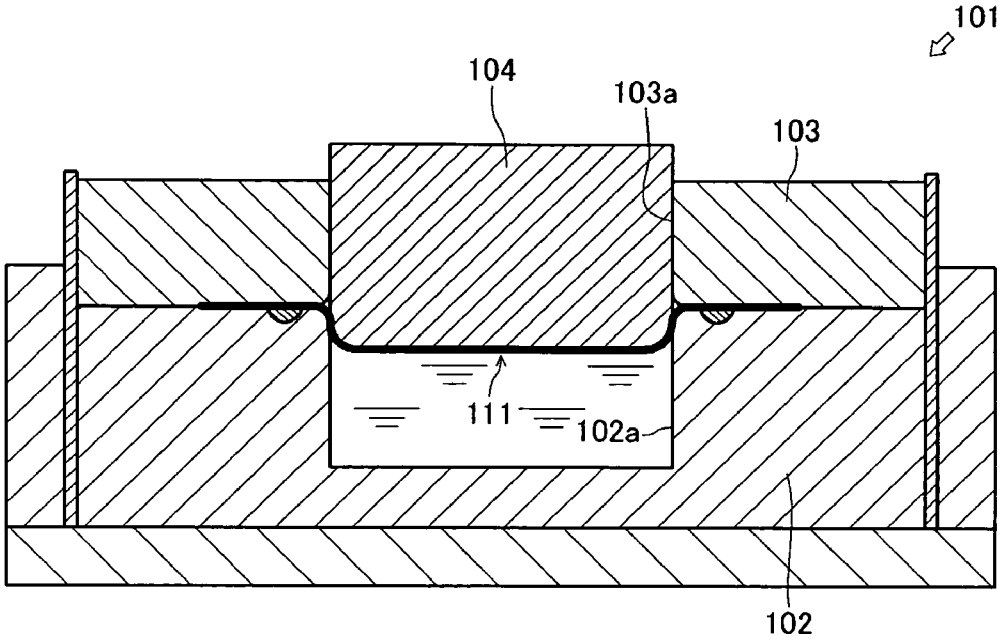
FIG. 8 is a side sectional view showing operation of a conventional hydroforming machine.

The conditions of (A) are not concerned with change of amount of insertion (position of the punch 4) to fluid tank 2*a* of punch 4, and the pressure controller 5 is not operated (the state where the valve 52 was always closed). The pressure of the water filled in the fluid tank 2*a* increases, according to the increase of amount of insertion to fluid tank 2*a* of punch 4. The condition of (A) is roughly same with the conditions using conventional hydroforming machine 101 in FIG. 8:

On the conditions of (B), the pressure controller 5 is operated (the state where the valve 52 was opened suitably) to keep the pressure of the water filled in the fluid tank 2*a* is held to abbreviation regularity (pressure P2), when amount of insertion to the fluid tank 2*a* of the punch 4 is more than S2. In addition, amount of insertion to the fluid tank 2*a* of the punch 4 which is the horizontal axis of FIG. 2. It makes zero point which is the position contacted thin board 11 with the tip part of punch 4 first, when the punch 4 is moved in the direction inserted in the fluid tank 2*a*.

Figure 3:
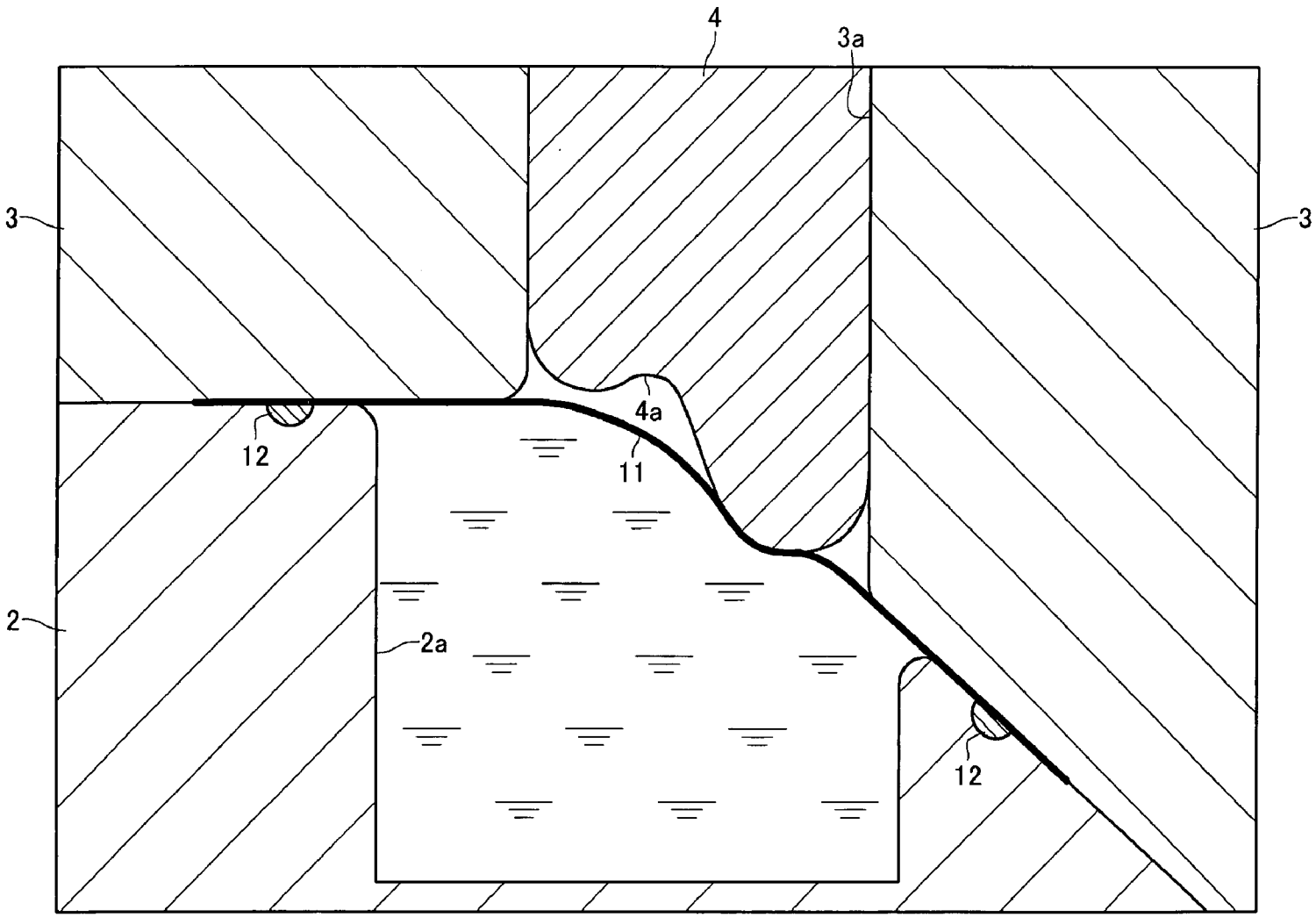
FIG. 3 is a side sectional view showing the punch at the time of (a) in FIG. 2, and the relation of the thin board.
Figure 4:
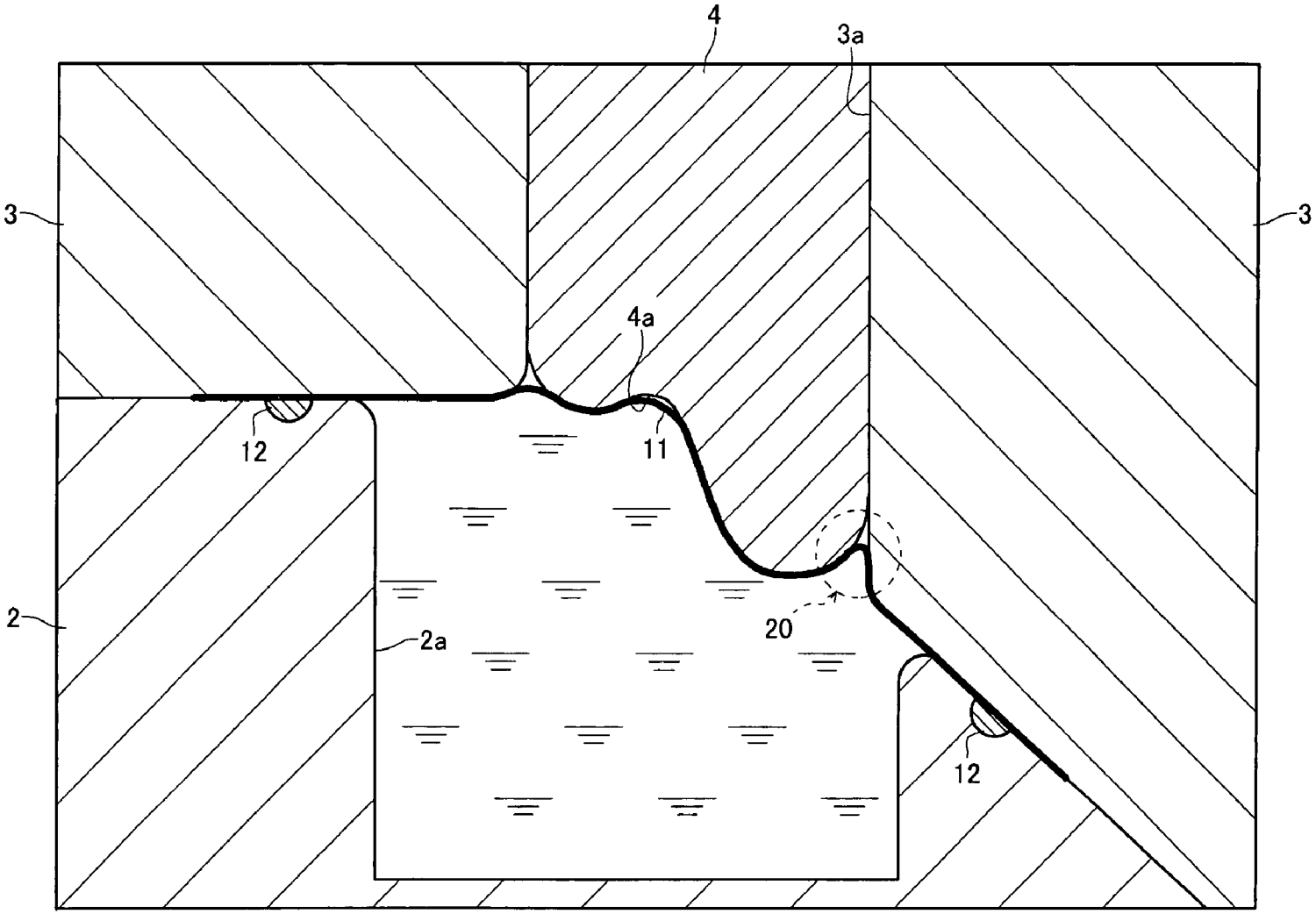
FIG. 4 is a side sectional view showing the punch at the time of (b) in FIG. 2, and the relation of the thin board.
Figure 5:
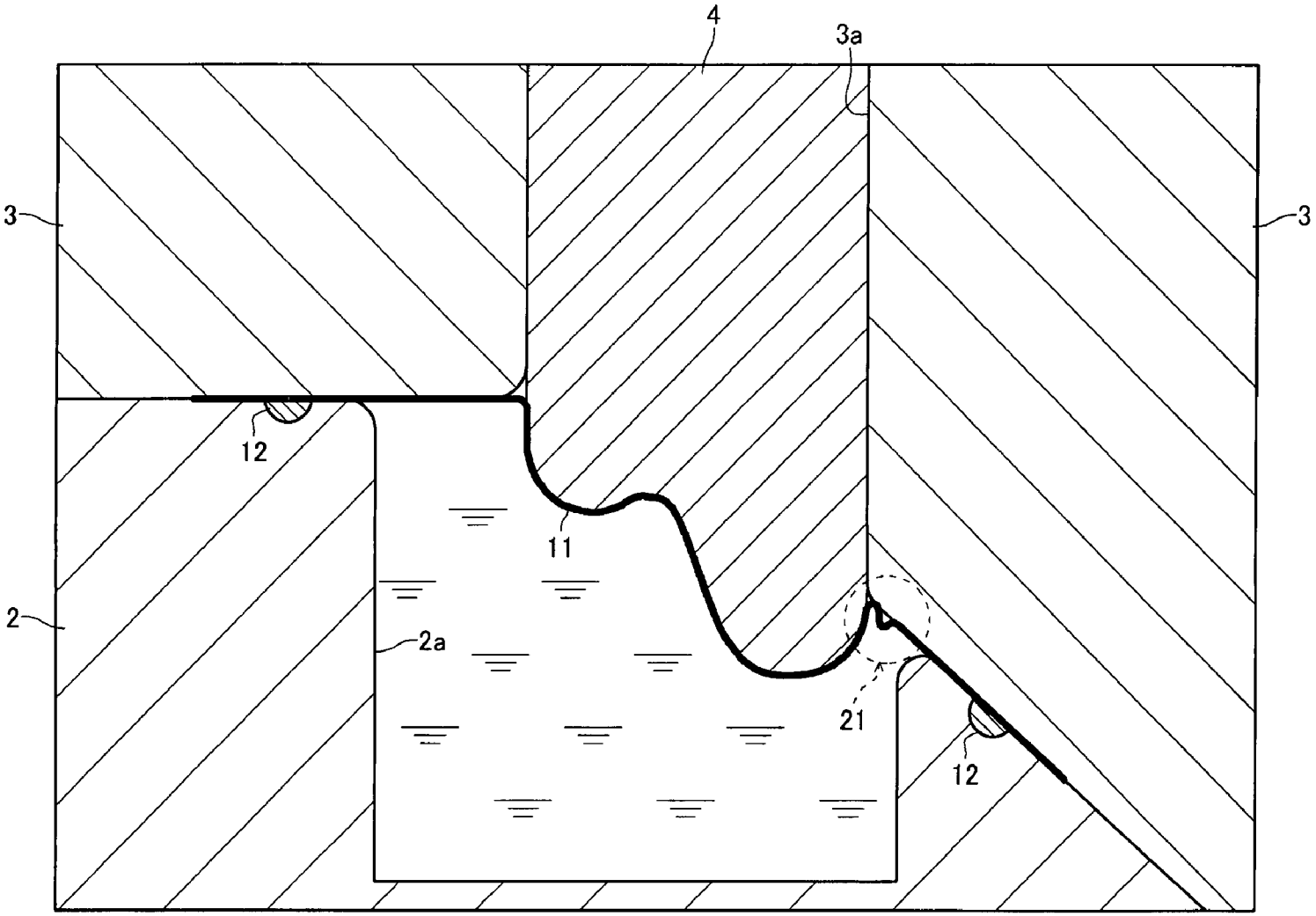
FIG. 5 is a side sectional view showing the punch at the time of (c) in FIG. 2, and the relation of the thin board.

With the following in FIGS. 3, 4, and 5, the details of the modification action of thin board 11 are explained, when forming of the thin board 11 is performed on condition that (A).

Figure 2:
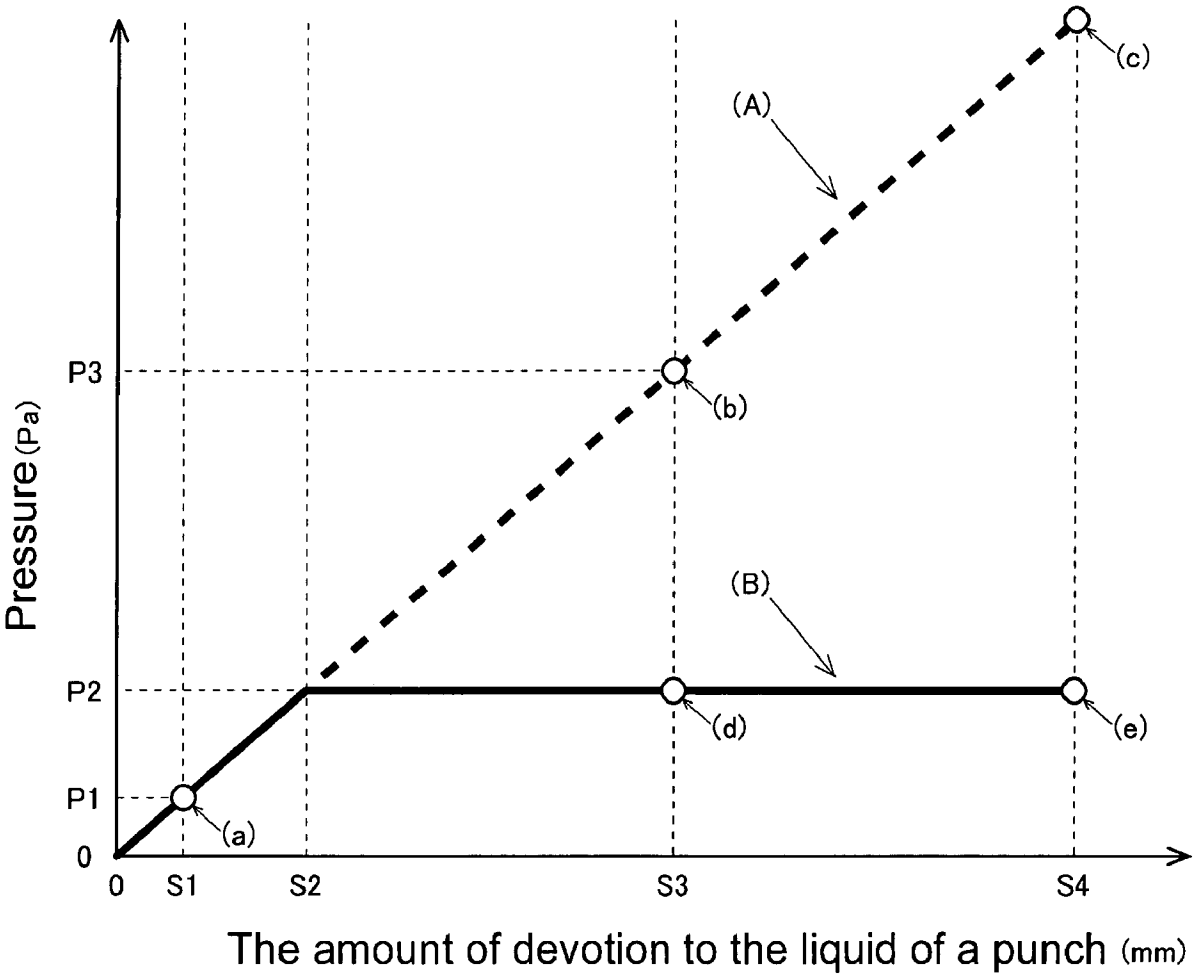
FIG. 2 depicts a relationship between the pressure of the liquid with an amount of insertion and the fluid tank is filled up with a punch.

FIG. 3 is a side sectional view showing the relation between punch 4 and thin board 11 on the conditions of (A) (or conditions of (B)), when forming of thin board 11 is performed and amount of insertion to fluid tank 2*a* of punch 4 is S1 (it corresponds to (a) in FIG. 2). With the point of amount of insertion into the fluid tank 2*a* of punch 4 being S1, the pressure (P1) of the water filled in the fluid tank 2*a* is not raised so much. Only the portion of the thin board 11 in contact with punch 4 is deformed accordance with the shape of the punch 4.

FIG. 4 is a side sectional view showing the relation between the punch 4 and the thin board 11 on the conditions of (A) when forming of thin board 11 is performed, and amount of insertion to fluid tank 2*a* of punch 4 is S3 (it corresponds to (b) in FIG. 2). One of the advantages of forming by this hydroforming machine is being able to prevent generating wrinkle. The thin board 11 deformed with pulling force by the pressure of the water filled in the fluid tank 2*a*, because of deformation of the thin board along with the cavity 4*a*, when the cavity 4*a*, which is a dent, is formed on the tip part of punch 4. However, the shape of the punch 4, there is a case generated the dent 20 similar to cavity 4*a* temporarily in the crevice between the through hole 3*a*, for installing the punch 4 on the holder 3, and the punch 4. The high pressure of the water in the fluid tank 2*a* (P3) makes the thin board 11 deforms along such a dent 20.

FIG. 5 is a side sectional view showing the relation between punch 4 and thin board 11 when forming of the thin board 11 is performed and amount of insertion to the fluid tank 2*a* of the punch 4 is S4 (it corresponds to (c) in FIG. 2) on the condition of (A). The amount of insertion to fluid tank 2*a* of the punch 4 becomes larger, and a dent 20 is lost, the portion which became depressed in thin board 11 and was changed along with 20 will shrink and be deformed, and wrinkled part 21 occurs.

Mentioned above, on the conditions of (A), the water pressure increase along with the amount of the insertion to fluid tank 2*a* of punch 4, and it becomes the cause of generating of wrinkle for Generating of a temporary dent 20 in the process of devotion to fluid tank 2*a* of punch 4. That is, when forming the thin board 111 using conventional hydroforming machine 101 shown in FIG. 8, it is difficult to prevent generating of such wrinkle.

Below, the details of the modification action of the thin board 11 are explained in FIGS. 3, 6, and 7, when forming of the thin board 11 is performed on condition that (B):

FIG. 3 is a side sectional view showing the relation between punch 4 and thin board 11, amount of insertion to fluid tank 2*a* of punch 4 is S1 (it corresponds to (a) in FIG. 2), when forming of thin board 11 is performed on condition that (B) (or conditions of (A)).

The pressure (P1) of the water with which fluid tank 2*a* was filled up is not raising so much, only the portion in contact with punch 4 of thin board 11 is deformed in accordance with the form of punch 4.

Figure 6:
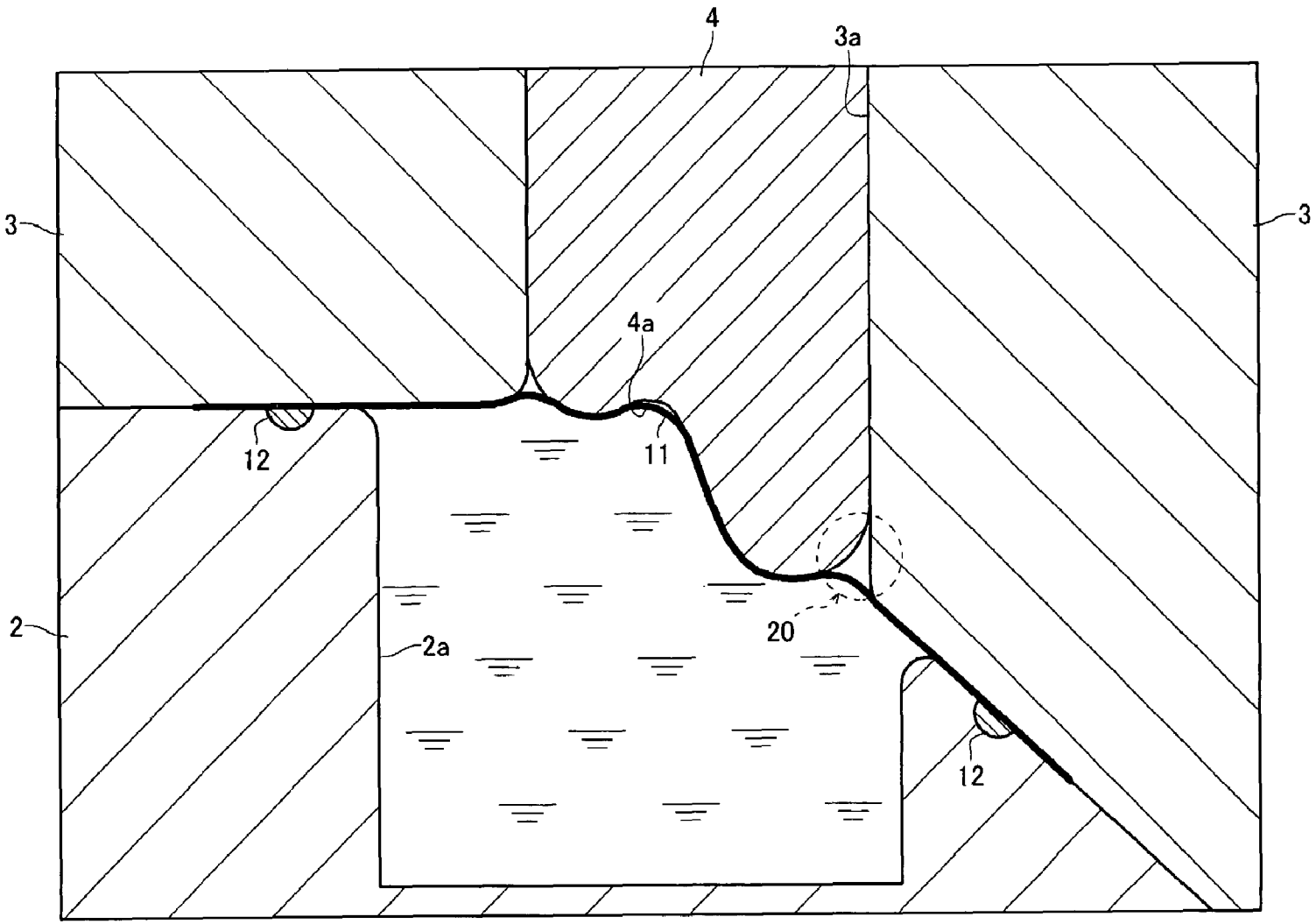
FIG. 6 is a side sectional view showing the punch at the time of (d) in FIG. 2, and the relation of the thin board.

FIG. 6 is a side sectional view showing the relation between the punch 4 and the thin board 11, on the conditions of (B), when forming of thin board 11 is performed and amount of insertion to fluid tank 2*a* of punch 4 is S3 (it corresponds to (d) in FIG. 2).

On the conditions of (B), pressure controller 5 being operated, even if amount of insertion to fluid tank 2*a* of punch 4 increases, the pressure of the water with which fluid tank 2*a* was filled up is held to abbreviation regularity After the point the pressure of the water with which fluid tank 2*a* was filled up is lower than the pressure P2 which the thin board 11 deformed along with a dent 20 (the point of amount of insertion to fluid tank 2*a* of punch 4 being set to S2).

Therefore, the pressure of the water with which fluid tank 2*a* at the time of being shown in FIG. 6 was P2 and the thin board 11 is not deformed along with 20.

Figure 7:
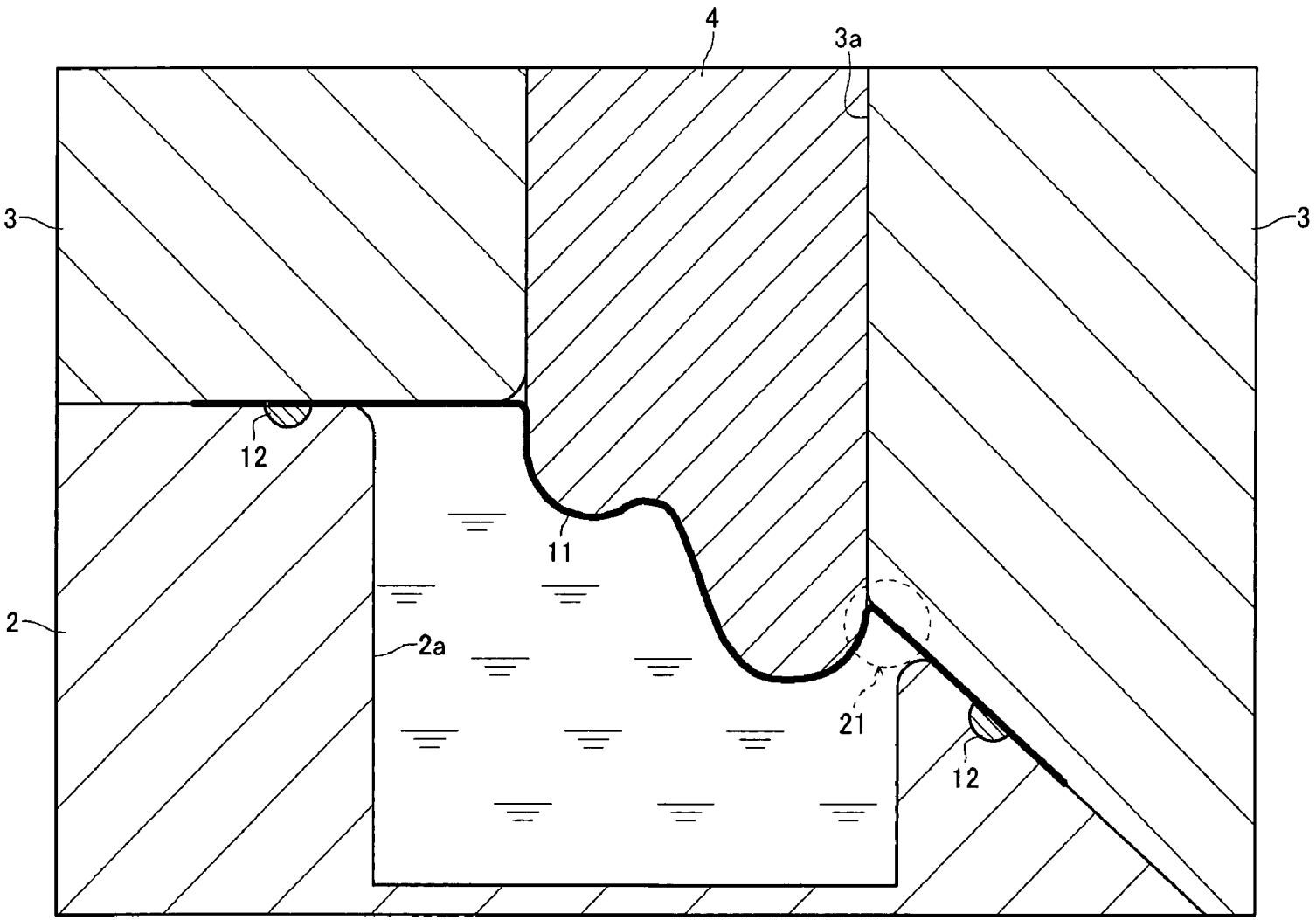
FIG. 7 is a side sectional view showing the punch at the time of (e) in FIG. 2, and the relation of the thin board.

FIG. 7 is a side sectional view showing the relation between punch 4 and thin board 11, when amount of insertion to the fluid tank 2*a* of the punch 4 is S4 (it corresponds to (e) in FIG. 2) and forming of the thin board 11 is performed on condition that (B).

On condition (B), the thin board 11 is not deformed along with the dent 20 while the dent 20 has occurred, amount of insertion to the fluid tank 2*a* of the punch 4 becomes larger, and wrinkle does not occur in absence of a dent 20.

Above mentioned, on the conditions of (B), even when it became depressed temporarily and dent 20 occurs between punch 4 and holders 3, pressure of the water filled in the fluid tank 2*a* while the dent 20 has occurred, holding to the pressure P2 lower than the pressure which the thin board 11 deformed along with 20, so it is possible to prevent generating of wrinkle.

In addition, the method of the above (B) is one of the examples to control the liquid pressure according to the position of the punch 4 by pressure controller 5. Moreover, it is also possible to apply methods other than the method of (B) applying to the forming of the thin board 11, according to the thickness, or the quality of the material, etc.

As other methods, there is a method possessing the step which increases the pressure of the water filling the fluid the tank 2*a* according to amount of insertion to the fluid tank 2*a* of punch 4, the step which holds the pressure of the water with which fluid tank 2*a* was filled up to abbreviation regularity even if amount of insertion to fluid tank 2*a* of punch 4 increases, and the step which increases the pressure of the water with which fluid tank 2*a* was again filled up with increase of amount of insertion to fluid tank 2*a* of punch 4, etc. is mentioned.

Like the above, the hydroforming machine 1 which is an embodiment of this invention is a hydroforming machine molding a board shape blank 11 provides the die 2 having a opening on the upper surface and the fluid tank 2*a* filled with fluid, the holder 3 being able to hold a periphery part between the die 2 and the holder 3, the punch 4 being movable in a direction into or out for the fluid tank 2*a*, and a fluid pressure controller 5 controlling the fluid pressure in the fluid tank 2*a* according to the position of the punch 4.

Thus, by constituting, it is possible to prevent generating of wrinkle for thin board 11 effectively also in the case the form complicated shape.

Moreover, the pressure controller 5 of hydroforming machine 1 which is an embodiment of this invention provides the through hole 51 which connects the outer side of die 2 to the fluid tank 2*a*, the valve 52 arranged at the halfway part of the through hole 51, the pressure sensor 53 which detects the pressure of the liquid filed in fluid tank 2*a*, the position sensor 54 which detects the position of punch 4.

It is simple composition, without using actuators, such as hydraulic cylinder, etc., and it is possible to adjust the pressure of the water of fluid tank 2*a*, and it make easy to maintenance and reduce the manufacture cost of hydroforming machine 1.

Moreover, the hydroforming machine 1 which is an embodiment of this invention make a dent in the portion which contacts the tip part of punch 4 in thin board 11, wherein the shape of the dent is roughly same shape with the tip of the punch 4.

Thus, by constituting, it is possible to mitigate distortion of the shrinkage direction generated to the contact part concerned, in case the tip part of punch 4 contacts thin board 11, and to prevent generating of wrinkle more effectively.

The method for liquid pressure forming which is an embodiment of this invention uses a hydroforming machine provides the die 2 in which fluid tank 2*a* with which an opening is carried out to the upper surface and a liquid is filled up was formed, the holder 3 which can pinch the periphery part of thin board 11 between die 2, The punch 4 which can move in the direction evacuated from the direction and fluid tank 2*a* inserted in fluid tank 2*a*, and make a dent roughly same shape with the tip of the punch 4 on the portion which contacts the tip part of punch 4 of thin board 11 before forming.

Thus, by constituting like that, it is possible to prevent generating of wrinkle for thin board 11 effectively also in case of forming a complicated shape.

Moreover, it is possible to mitigate distortion of the shrinkage direction generated to the contact part concerned, in case the tip part of punch 4 contacts the thin board 11, and to prevent generating of wrinkle more effectively.

The invention claimed is:

1. A hydroforming machine for molding a blank comprising:

a lower die having an opening on an upper surface thereof and a fluid tank containing fluid;

an upper die configured to hold a peripheral portion of the blank between the lower die and the upper die;

a movable punch being movable in a first direction into the fluid tank and a second direction out of the fluid tank; and a fluid pressure controller controlling fluid pressure in the fluid tank according to a position of the movable punch which is held lower than a pressure at which the blank can deform into a space temporarily formed between the movable punch, the upper die, and the blank.

2. The hydroforming machine recited in claim 1 wherein said fluid pressure controller further comprises:

a passage connecting the fluid tank to an exterior of the lower die;

a valve provided at a position midway along a length of the passage;

a fluid pressure detection means for detecting the fluid pressure in the fluid tank; and a movable punch position detection means for detecting a position of the movable punch.

3. The hydroforming machine recited in claim 1 wherein said blank has a dent approximately corresponding in shape with a tip of the movable punch.

4. A method for molding a blank comprising:

providing the blank on a lower die, said lower die having an opening and a fluid tank containing fluid;

holding a peripheral portion of the blank between an upper die and the lower die; and moving a punch against the blank and through an opening in the lower die to push a central portion of the blank into the fluid tank while controlling a pressure of the fluid in the fluid tank depending on a position of the movable punch, while holding the pressure lower than a pressure needed to deform the blank into a space temporarily formed between the movable punch, the upper die, and the blank.

5. The method recited in claim 4, wherein moving the punch through an opening in the lower die further comprises defining a dent in the blank approximately corresponding to a tip of the movable punch.

* * * * *